US011696607B2

(12) United States Patent
Young

(10) Patent No.: US 11,696,607 B2
(45) Date of Patent: Jul. 11, 2023

(54) COVERING FOR PROTECTING A LOWER REGION OF A USER

(71) Applicant: Aquito Carl Young, Osceola Mills, PA (US)

(72) Inventor: Aquito Carl Young, Osceola Mills, PA (US)

( * ) Notice: Subject to any disclaimer, the term of this patent is extended or adjusted under 35 U.S.C. 154(b) by 73 days.

(21) Appl. No.: 17/247,131

(22) Filed: Dec. 1, 2020

(65) Prior Publication Data

US 2021/0161220 A1 Jun. 3, 2021

Related U.S. Application Data

(60) Provisional application No. 62/974,454, filed on Dec. 2, 2019.

(51) Int. Cl.
*A41D 3/00* (2006.01)

(52) U.S. Cl.
CPC ..... *A41D 3/00* (2013.01); *A41D 2400/10* (2013.01)

(58) Field of Classification Search
CPC ..... A41D 3/00; A41D 3/08; A41D 2400/10; A41D 2400/422; A41D 15/04; A41D 10/00; A41D 2600/108; A41D 7/008; A47G 9/066; A47G 9/06; A47G 9/08; A47G 9/083; A47G 9/086; A47G 9/006; A47G 9/02; A41B 13/06; B62J 17/065; B62J 17/00
USPC ..... 2/69.5, 69; 296/81, 82, 77.1; D2/860
See application file for complete search history.

(56) References Cited

U.S. PATENT DOCUMENTS 633,134 A * 9/1899 Hansen ..... B60N 2/6009 296/81
704,276 A * 7/1902 Sorensen ..... A61G 5/10 296/81
886,907 A * 5/1908 Werle ..... B60N 2/6009 296/81
1,265,539 A * 5/1918 Slater ..... A41B 13/06 5/413 R
1,425,952 A * 8/1922 Fidler ..... A47G 9/04 5/494
1,704,504 A * 3/1929 Hedden ..... A41D 13/04 2/69
2,230,689 A * 2/1941 Kemp ..... A47G 9/066 D2/719
2,716,239 A * 8/1955 Barndollar ..... A41B 13/06 2/69.5
3,329,971 A * 7/1967 Shelby ..... A47C 7/666 2/69
10,166,902 B2 * 1/2019 Cayzer ..... B64D 11/0646

* cited by examiner

*Primary Examiner* — Katherine M Moran
*Assistant Examiner* — Haley A Smith
(74) *Attorney, Agent, or Firm* — Dunlap Bennett & Ludwig, PLLC

(57) ABSTRACT

A covering is disclosed that is designed to protect the lower region of a user while seated on a seat. The covering includes a front portion and a back portion, with both being formed from a pliable material. The front portion and the back portion are connected to form a pocket, with the front portion and the back portion further defining an opening configured to receive legs of the user. Further, a flap is connected to and extends from an end of the back portion proximal the opening, the flap being configured to be sat on by the user.

12 Claims, 4 Drawing Sheets

COVERING FOR PROTECTING A LOWER REGION OF A USER

CROSS-REFERENCE TO RELATED APPLICATION

This application claims the benefit of priority of U.S. provisional application No. 62/974,454, filed Dec. 2, 2019, the contents of which are herein incorporated by reference.

BACKGROUND OF THE INVENTION

The present invention relates to insulated coverings and, more particularly, to an insulated covering for protecting an individual's legs and feet while attending outdoor events during inclement weather and/or cold temperatures.

Individuals that attend outdoor events, such as a sports game, often are exposed to extreme weather elements, such as cold weather, wind, rain, and other precipitation. Many upper body jackets exist to keep the individual's chest, arms, and head warm, but the legs, feet and buttocks of an individual are also exposed to the same elements. In many instances, the surface being sat on (such as a stadium seat) is cold and/or wet due to the weather conditions that day.

There are no products available, at present, that are easy to slip on over the legs, feet, and buttocks that insulate the individual and provide three hundred sixty degrees of protection. For example, blankets draped over the legs do not adequately protect the back side of the legs, nor do they protect the feet or buttocks of an individual. As a result, conventional solutions to not allow body heat to adequately recirculate, which leads to discomfort and can even lead to severe health problems.

As can be seen, there is a need for a covering that ameliorates these above-described problems.

SUMMARY OF THE INVENTION

In one aspect of the present invention, a covering configured to protect a lower region of a user is disclosed, with the covering comprising: a front portion comprising a pliable material; a back portion comprising a pliable material, the back portion being connected to the front portion to form a pocket, the front portion and the back portion further defining an opening configured to receive legs of the user; and a flap connected to and extending from an end of the back portion proximal the opening, the flap being configured to be sat on by the user.

In another aspect of the present invention, a method of protecting a user from precipitation, cold temperatures, or both, is disclosed, with the method comprising: providing the previously described covering; inserting a first user leg and a second user leg into the opening; positioning the flap proximal a buttocks of the user; and sitting on a seat with the flap being disposed between the seat and the buttocks of the user.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a covering configured to protect a lower region of a user, the covering comprising: a front portion comprising a pliable material and a back portion comprising a pliable material. The back portion is connected to the front portion to form a pocket. The front portion and the back portion further define an opening which is configured to receive legs of the user. A flap is connected to and extends from an end of the back portion proximal the opening, with the flap being configured to be sat on by the user. When not in use, the opening defines a substantially cuboid shape.

In accordance with certain aspects of the present invention, a covering is provided that a user may, in use, step into which results in the user's legs and feet being almost entirely covered (and thus dry and/or insulated). Further, a flap extending away from an open end of the covering provides a seating area for the user to sit on to better ensure the user remains warm and dry. Embodiments of the present invention differ from presently available solutions because the user's bottom half is covered on all sides, including their feet and buttocks. Because three-hundred sixty-degree protection is provided for a user's lower region, body heat is more easily allowed to recirculate and keep the user warm and comfortable. In certain embodiments, the covering may protect the user all the way up to his or her stomach, which may be covered with, for example, a coat or jacket.

Figure 1:
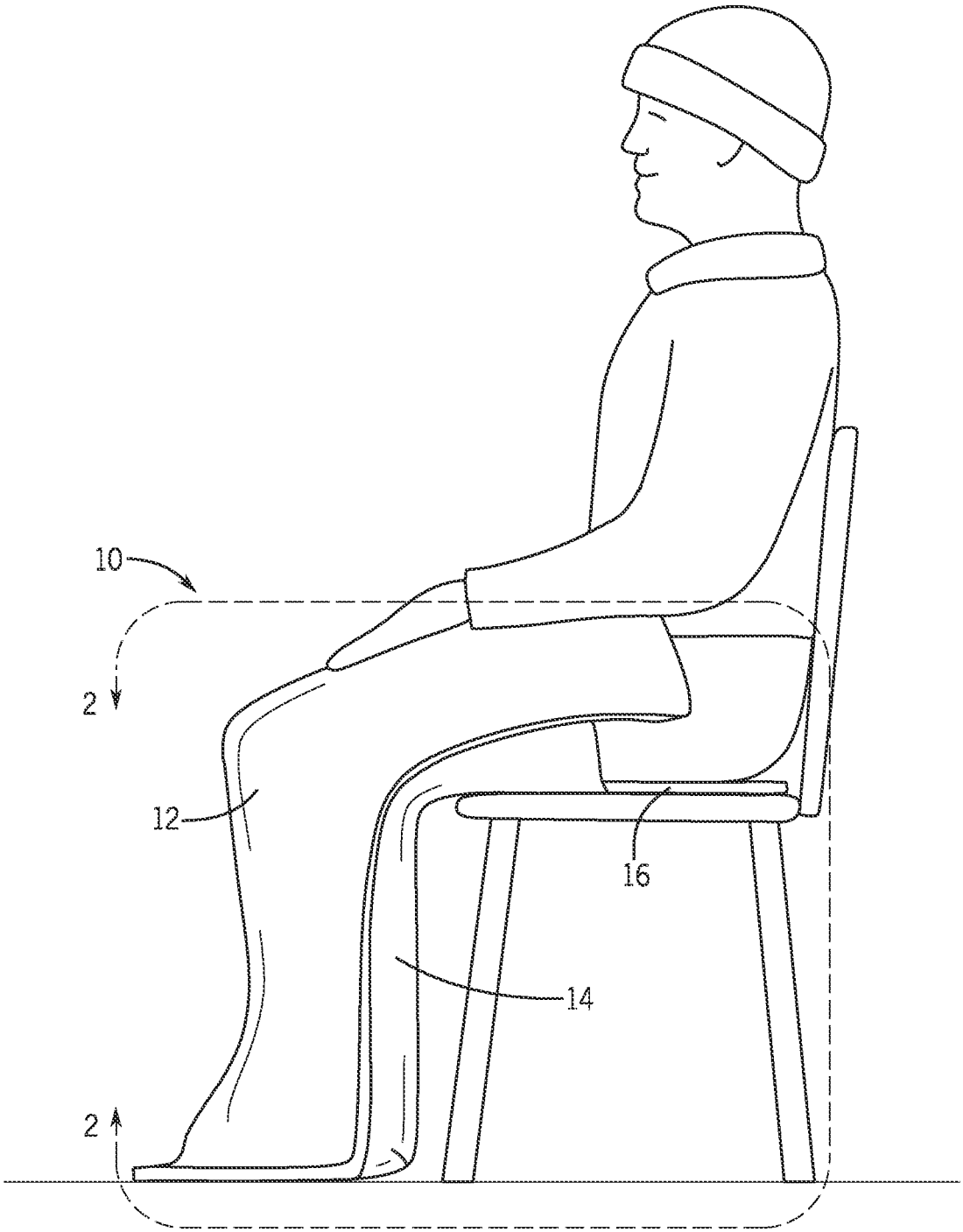
FIG. 1 is a side elevation view of an embodiment of the present invention, in use.
Figure 2:
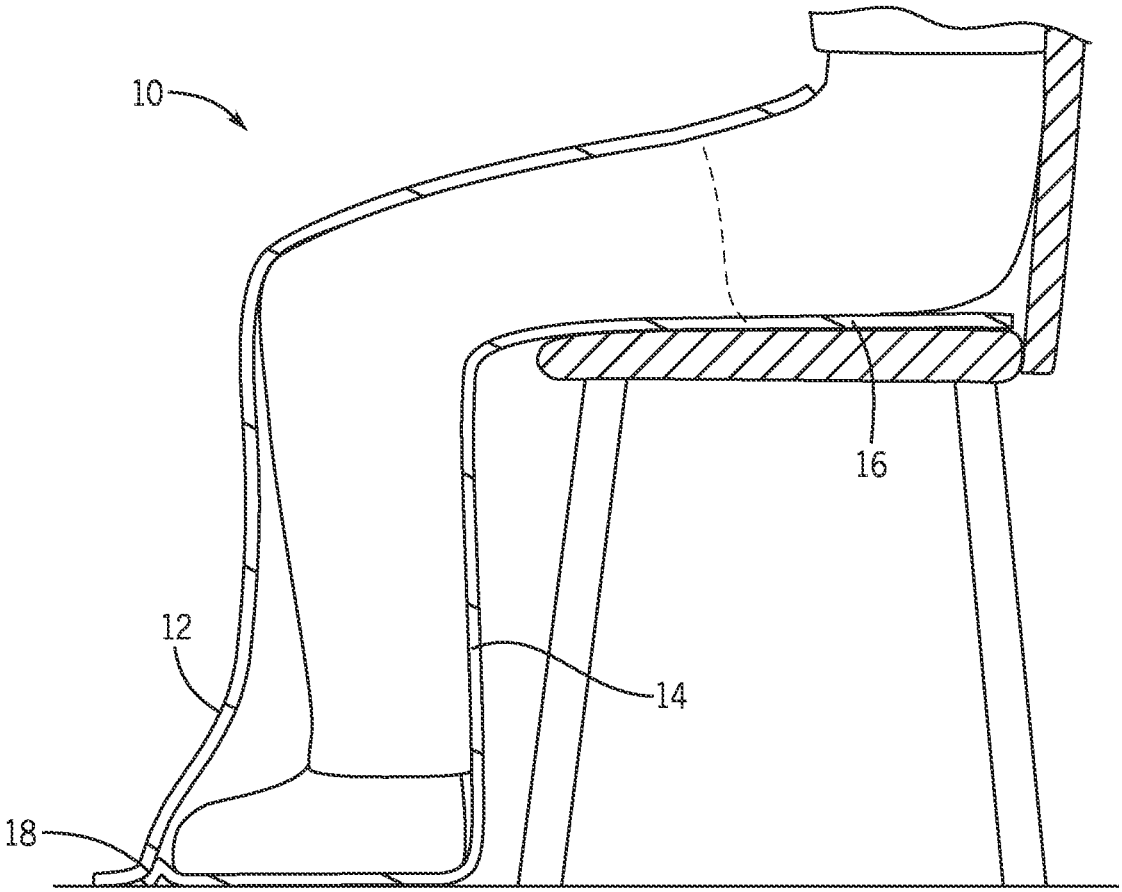
FIG. 2 is a detail cross-sectional view, cut relative to line 2-2 in FIG. 1, of the embodiment of the present invention, in use.
Figure 3:
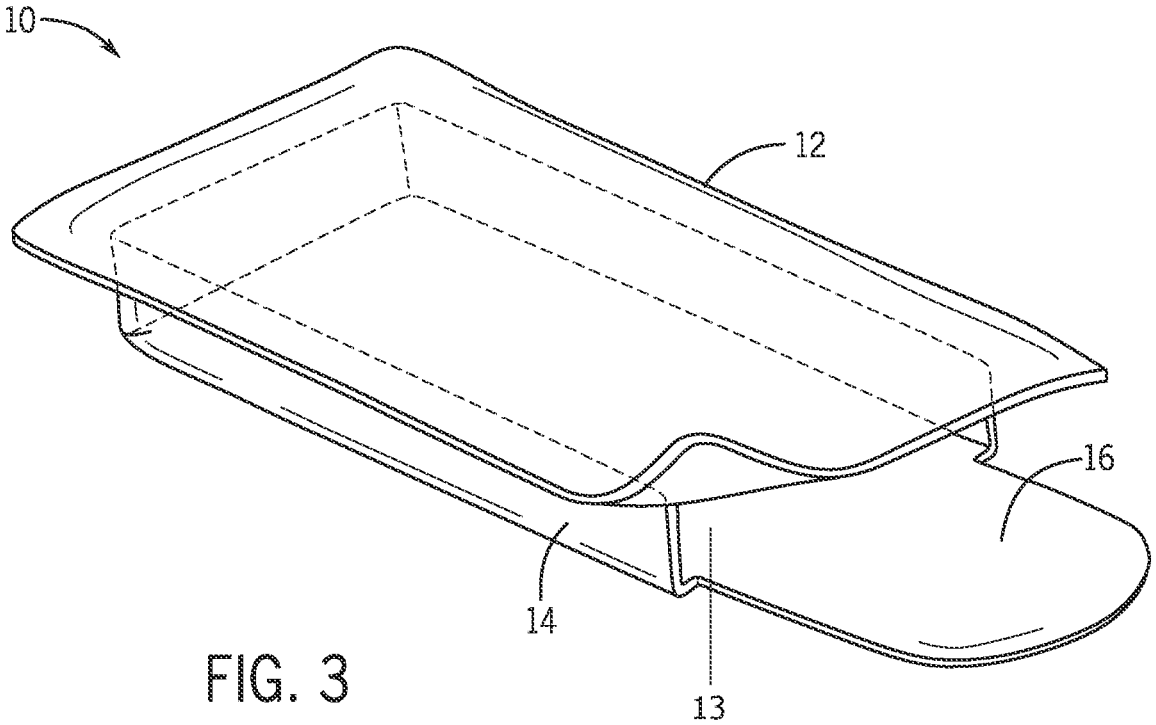
FIG. 3 is a perspective view of the embodiment of the present invention.
Figure 4:
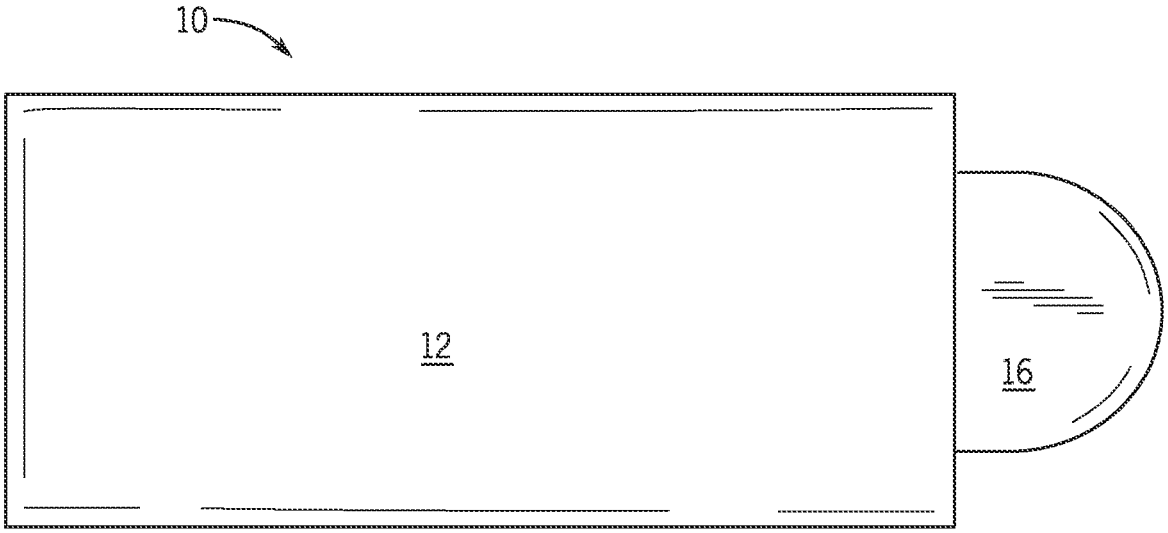
FIG. 4 is a top plan view of the embodiment of the present invention.
Figure 5:
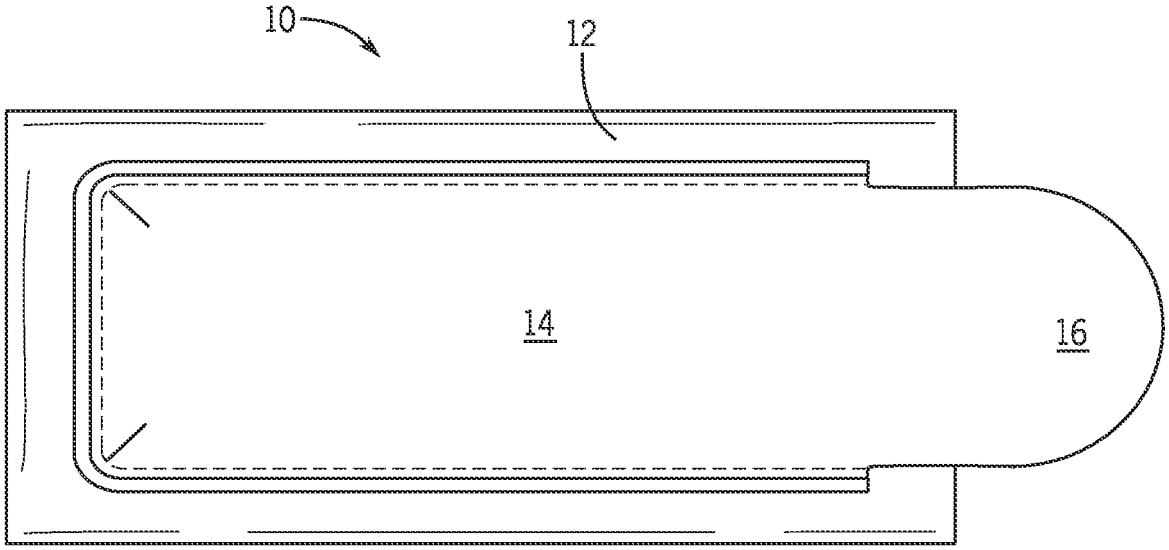
FIG. 5 is a bottom plan view of the embodiment of the present invention.
Figure 6:
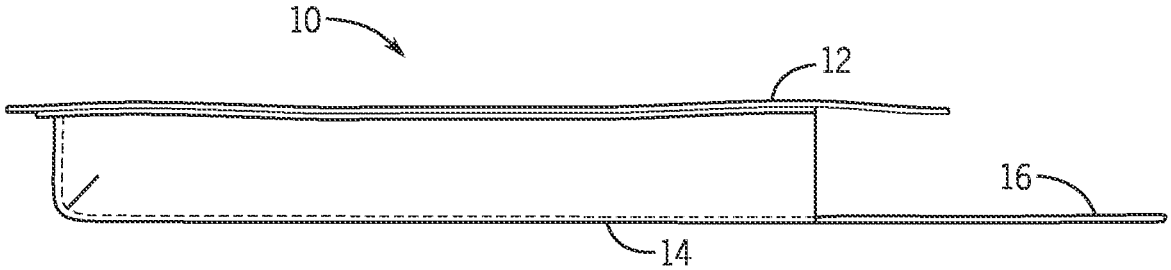
FIG. 6 is a side elevation view of the embodiment of the present invention.

Referring to FIGS. 1-6, a pouch-like covering 10 include a front portion 12 for covering a front region of a user's legs and feet and a back portion 14, connected to the front portion 12, for covering the user's buttocks and back region of his or her legs and feet. As shown in FIGS. 1-6, the front portion 12 and the back portion 14 may have a sheet-like disposition, while, in other embodiments, they may each include insulative material embedded between two sheets. As shown in FIG. 2, the front portion 12 and back portion 14 completely encircle the user's legs and feet, thus providing maximum protection from weather elements and allowing the body heat of the user to remain trapped in the covering 10 rather than escaping via an uncovered side. In certain embodiments, the front portion 12 and the back portion 14 constitute the only distinct elements of the invention (besides threading, adhesive or other means to connect the two together). The front portion 12 and back portion 14, in combination, form a closed side (left side of the covering 10 as shown in FIG. 6) and an open side (right side of the covering 10 as shown in FIG. 6).

Advantageously, a flap 16 extends from an open side edge of the back portion to serve as a seating area for the user's buttocks, as shown in FIG. 1. This feature is of particular use when it has either precipitated already or is currently precipitating, as it provides protection from standing water on the seat, but it also provides insulation for the buttocks of the user.

As shown, for example, in FIGS. 2, 3, 5 and 6, a joint 18 connects the front portion 12 and the front portion 14. In certain embodiments, the joint 18 is a seam, but various methods of attaching the portions may be employed in accordance with the present invention. In all embodiments of the present invention, the joint 18 is formed at the closed end of the covering 10 such that sufficient space for the user's feet is provided, as shown in FIG. 2. In certain embodiments of the present invention, the spacing between a front-most surface of the front portion 12 and a back-most surface of the back portion 14 (as shown, for example, in FIGS. 2 and 6) may be approximately 12 inches proximal the closed end of the covering 10 and approximately 5 inches proximal the open end of the covering 10. It will be appreciated, of course, that this spacing may be modified while remaining within the spirit and scope of the present invention.

As shown in FIGS. 5 and 6, peripheral material defined by an outer perimeter of the front portion 12 extends beyond a perimeter generally defined by the joint 18. This configuration provides several benefits. First, the material from the outer perimeter overhangs the front portion 12 in use, as shown in FIGS. 1 and 2, giving the covering 10 the look of a blanket while offering superior performance. In particular, the overhanging material effectively serves as a windbreaker at those portions of the covering 10 to further protect the user. In certain embodiments, this overhang on each side may be approximately 5 inches. Second, as shown in FIG. 2, the overhanging material allows the covering 10 to extend further up the user's leg or lap than would otherwise be possible (because the overhanging material is not constricted to bend to adjust to the user's lap). The dashed line in FIG. 2 shows the open side edge of the back portion 14, with the overhanging material extending there beyond and up the user's leg proximal the stomach of the user. Third, the overhanging material better facilitates a user slipping on the covering, as it provides an area for the user to grasp. The overhanging material in combination with the flap create a funneling effect to direct the user's feet more effectively into the covering.

Embodiments of the present invention may be formed from various waterproof or non-waterproof materials, such as, but not limited to: nylon, fleece or treated waterproof materials, plastic, canvas, synthetics, or other natural materials. In certain embodiments, the front portion 12 and back portion 14 may be formed from the same material(s), but in other embodiments, they may be formed from different materials. While in the illustrated embodiment the front portion 12 and the back portion 14 are illustrated as distinct elements, in other embodiments, they may be configured as a single element. Advantageously, embodiments of the present invention may be formed without fasteners (such as buttons or zippers), thus simplifying the manufacture (i.e., less parts to attach) and functionality thereof (i.e., there is no additional step needed of zipping up a zipper once the user's legs have been placed within the covering 10). Additionally, the covering 10 may be provided in several sizes for varying height users or may be in a one-size-fits-all format.

A method of making the present invention may include the following. The front portion 12 and back portion 14 are first cut to shape and size, with the back portion 14 being cut such that a back flap 16 is formed. Next, the front portion 12 and the back portion 14 may be connected using various methods for stitching and/or waterproofing methods for covering joints. In embodiments where the covering 10 is formed from one or more plastic materials, other methods, such as heat bonding, may be used to attach the front portion 12 and back portion 14 at the joint 18. Other methods of making the present invention would be readily apparent to those with skill in the art in view of the present disclosure.

A method of using the present invention may include the following. First, a user may insert his or her legs into the opening 13 of the covering and slide his/her legs to the closed end of the covering. Next, the user may position the flap proximal his/her buttocks and may sit down on a seat. Consequently, the flap is disposed between the user's buttocks and the seat and the rest of the covering surrounds the user's feet and legs, allowing the user to remain dry and warm no matter what the weather is.

It should be understood, of course, that the foregoing relates to exemplary embodiments of the invention and that modifications may be made without departing from the spirit and scope of the invention as set forth in the following claims.

What is claimed is:

1. A covering configured to protect a lower region of a user, the covering comprising:

a front portion comprising a pliable material;

a back portion comprising a pliable material, the back portion being connected to the front portion to form a pocket with a closed side and an open side opposite the closed side, the front portion and the back portion further defining an opening configured to receive legs of the user; and a flap connected to and extending from an end of the back portion proximal the opening, and the flap being configured to be sat on by the user, wherein the front portion and the back portion are connected at a joint, and peripheral material of the front portion extends beyond the joint at least at the closed side of the covering and lateral sides of the covering, wherein neither the front portion nor the back portion include releasable fasteners.

2. The covering of claim 1, wherein the flap is integral with the back portion.

3. The covering of claim 1, wherein the peripheral material of the front portion extends beyond the joint in a direction away from a center of the front portion.

4. The covering of claim 1, wherein the peripheral material extends beyond the joint approximately five inches.

5. The covering of claim 1, wherein peripheral material of the front portion extends past the opening in a same direction as the flap extending from the end of the back portion.

6. The covering of claim 1, wherein the pliable material of the front portion is insulative, waterproof, or both insulative and waterproof, and the pliable material of the back portion is insulative, waterproof, or both insulative and waterproof.

7. The covering of claim 1, formed without fasteners.

8. The covering of claim 1, wherein a distal edge of the flap is a curve that interconnects each of the two lateral edges of the flap, whereby the curve is configured to fit a seat portion of a stadium seating.

9. The covering of claim 1, wherein the joint is defined by at least three edges of the back portion.

10. A method of protecting a user from precipitation, cold temperatures, or both, the method comprising:

providing the covering of claim 1;

inserting a first user leg and a user second leg into the opening;

positioning the flap proximal a buttocks of the user; and sitting on a seat with the flap being disposed between the seat and the buttocks of the user.

11. A covering configured to protect a lower region of a user, the covering comprising:

a front portion comprising a pliable material;

a back portion comprising a pliable material, said back portion being connected to the front portion along a joint to form a pocket with a closed side and an open side opposite the closed side, wherein the joint is defined by three edges of the back portion, the front portion and the back portion further defining an opening configured to receive legs of the user; and a flap connected to and extending from an end of the back portion proximal the opening, and the flap being configured to be sat on by the user, wherein an overhang of peripheral material of the front portion extends beyond the joint at least at the closed side of the covering and lateral sides of the covering, wherein neither the front portion nor the back portion include releasable fasteners.

12. The covering of claim 11, wherein a distal edge of the flap is a curve that interconnects each of two lateral edges of the flap, whereby the curve is configured to fit a seat portion of a stadium seating.

* * * * *